US007387014B2

(12) United States Patent
Banyard

(10) Patent No.: US 7,387,014 B2
(45) Date of Patent: Jun. 17, 2008

(54) VACUUM GENERATOR FOR VACUUM-DECAY LEAK TESTING THE EVAPORATIVE EMISSIONS SYSTEM OF A MOTOR VEHICLE

(75) Inventor: Richard L. Banyard, Edmonton (CA)

(73) Assignee: STAR EnviroTech, Inc., Costa Mesa, CA (US)

( * ) Notice: Subject to any disclaimer, the term of this patent is extended or adjusted under 35 U.S.C. 154(b) by 561 days.

(21) Appl. No.: 11/139,794

(22) Filed: May 31, 2005

(65) Prior Publication Data

US 2006/0269422 A1 Nov. 30, 2006

(51) Int. Cl.
*G01M 3/02* (2006.01)

(52) U.S. Cl. ..... 73/49.7; 73/40.5 R

(58) Field of Classification Search ..... 73/49.7, 73/40.5 R

See application file for complete search history.

(56) References Cited

U.S. PATENT DOCUMENTS 5,069,062 A * 12/1991 Malecek et al. ..... 73/49.7
5,763,764 A * 6/1998 Mieczkowski et al. ..... 73/40

* cited by examiner

*Primary Examiner*—Hezron E. Williams
*Assistant Examiner*—John Fitzgerald
(74) *Attorney, Agent, or Firm*—Morland C. Fischer

(57) ABSTRACT

A compact (e.g., hand held) vacuum generator having particular application for creating a vacuum within the evaporative emissions system (e.g., a gas tank) of a motor vehicle so that a vacuum-decay test can be performed to test the system for leaks while mitigating the hazardous effects of potentially explosive hydrocarbon vapors. The vacuum generator includes a spool valve that has an internal passage and is capable of sliding through a spool valve bore in response to a pushing force. During an at-rest stage of the spool valve within the spool valve bore, the system to be tested is disconnected from the vacuum generator. During a transition stage of the spool valve within the spool valve bore, inlet gas under pressure is blown through the internal passage of the spool valve to the atmosphere by way of a vacuum generating venturi, whereby a vacuum begins to form in a vacuum passage. During a vacuum stage of the spool valve within the spool valve bore, the vacuum passage is connected between the vacuum generating venturi and the system under test at a dual vacuum inlet port so that the system will be evacuated to the atmosphere as inlet gas under pressure is blown to the atmosphere through the internal passage of the spool valve and the vacuum generating venturi. A vacuum gauge coupled to the dual vacuum inlet port is responsive to the decay of the vacuum created within the system under test to provide an indication of a leak.

20 Claims, 7 Drawing Sheets

AT REST STAGE

TRANSITION STAGE

VACUUM STAGE

VACUUM GENERATOR FOR VACUUM-DECAY LEAK TESTING THE EVAPORATIVE EMISSIONS SYSTEM OF A MOTOR VEHICLE

BACKGROUND OF THE INVENTION

1. Field of the Invention

This invention relates to a compact (e.g., hand held) vacuum generator having particular application in pulling a vacuum within the evaporative fuel emissions system (e.g., a gas tank) of a motor vehicle so that a vacuum-decay test can be performed to test the system for leaks while mitigating the hazardous effects of potentially explosive hydrocarbon vapors.

2. Background Art

Vacuum generating devices have been in use for many years. One example of a commercially available vacuum generating device is a hand operated vacuum pump sold under the trademark MITYVAC. Other commonly used vacuum producing devices include electric vacuum pumps designed to evacuate a variety of closed systems, such as an air conditioner refrigeration system of a motor vehicle or a commercial air conditioning system.

When the evaporative emissions system of a motor vehicle is to be tested for leaks by first creating a vacuum, the aforementioned hand operated vacuum pump has usually been employed because electric vacuum pumps are often known to draw excessive vacuum from a system under test. The vacuum force created by electric vacuum pumps is sometimes so large as to possibly collapse the evaporative emissions system of the motor vehicle under test. However, one common problem with using the typical hand operated vacuum pump for leak testing the evaporative emissions system of a motor vehicle is that a time delay of approximately 5 to 10 minutes is required to evacuate the system in order to be able to test the rate of leak. Another problem which is often faced by those performing the leak test is that the vapors which evacuate from the hand operated pump are flammable and could lead to a potentially hazardous explosive condition. Yet another problem is that after the hand operated vacuum pump is disconnected from a test port of the evaporative emissions system under test, ambient air is allowed to flow back into the system, thereby creating a potentially explosive mixture. Still another problem with the typical hand operated vacuum pump is that the vacuum level is selected by the technician performing the vacuum test. In one case, the vacuum level that is selected may pull too much vacuum and, consequently, damage the vehicle. In another case, not enough vacuum may be pulled rendering the test inaccurate.

Accordingly, conventional hand operated vacuum pumps may not be suitable for reliably testing the evaporative emissions system of a motor vehicle when a vacuum-decay (or vacuum-decline) method of testing is required. Therefore, what is needed is a testing apparatus that is especially adapted for testing the evaporative emissions system of a motor vehicle by means of vacuum-decay testing. In this regard, the improved apparatus should be capable of completing a test in a timely and safe manner, assuring repeatable results, being capable of not pulling more vacuum than required, and protecting the system under test as well as the technician by mitigating the hazards of handling flammable vapors in the potentially explosive environment of the test.

SUMMARY OF THE INVENTION

In general terms, a compact (e.g., hand held) vacuum generator is disclosed having particular application in pulling a vacuum within the evaporative emissions system of a motor vehicle so that a vacuum-decay test can be performed to reliably test the system for leaks. The vacuum generator includes a gas inlet port for receiving a supply of inlet gas (e.g., compressed air or an inert, non-combustible gas) under pressure. The inlet gas is delivered to an integrated spool valve that is adapted to slide through a spool valve bore in the vacuum generator. A pressure regulator controls the rate of flow of inlet gas from the gas inlet port to the spool valve to control the strength of the vacuum to be drawn. A spool valve control plunger to which a pushing force is applied causes the spool valve to slide through the spool valve bore.

The spool valve includes proximal and distal spools and an intermediate spool located therebetween. A first narrow relief area is located between the distal and intermediate spools, and a second narrow relief area is located between the intermediate and proximal spools. An orifice is formed in the first narrow relief area. The orifice communicates with an internal passage that runs longitudinally through the spool valve so that inlet gas can be supplied from the inlet port to the internal passage of the spool valve via the orifice. The internal passage of the spool valve is axially aligned with a stationary vacuum generating venturi and an exhaust port to the atmosphere. The exhaust port is preferably provided with a sound muffler and a flame arrester. A coil spring is located between the spool valve and the stationary venturi so as to automatically bias the spool valve towards an initial at-rest stage within the spool valve bore.

During the at-rest stage of the vacuum generator, no pushing force is applied to the spool valve control plunger that is connected to the spool valve. In this case, the intermediate spool of the spool valve is located in the spool valve bore so as to block communication between the gas inlet port and a duplex outlet port which can be connected to an optional sensor or to one or more slave units. At the same time, the orifice of the spool valve is isolated from the gas inlet port so that no inlet gas is supplied to the venturi by way of the internal passage of the spool valve. In addition, the proximal spool of the spool valve is located in the spool valve bore to interrupt communication between an internal vacuum passage and a dual vacuum inlet port. The dual vacuum inlet port is coupled to each of the system to be tested for leaks (e.g., a fuel tank) and a suitable vacuum gauge that is responsive to the vacuum-decay characteristics of the system under test.

During a transition stage of the vacuum generator, a pushing force is applied to the spool valve control plunger to cause the spool valve to slide through the spool valve bore. In this case, the first narrow relief area of the spool valve in which the orifice is located is partially positioned between the gas inlet port and the duplex outlet port. Accordingly, the coil spring between the spool valve and the stationary vacuum generating venturi will be compressed to store energy. Moreover, some of the inlet gas will begin to flow from the gas inlet port to the duplex outlet port. At the same time, inlet gas will also enter the orifice and flow through the internal passage of the spool valve. The inlet gas is blown from the internal passage of the spool valve to the atmosphere through the vacuum generating venturi and the exhaust port so as to disperse any lingering hydrocarbon vapors in the proximity of the vacuum generator. As the inlet gas is blown to the atmosphere from the venturi, a vacuum will begin to form in the internal vacuum passage. However, during the transition stage, the proximal spool of the spool valve is still located in the spool valve bore so as to block connection of the internal vacuum passage to the system under test at the dual vacuum inlet port.

During a vacuum stage of the vacuum generator, the aforementioned pushing force continues to be applied to the spool valve control plunger and the spool valve continues to slide through the spool valve bore so that the coil spring is now fully compressed to store its maximum energy. In this case, the first narrow relief area of the spool valve is located entirely between the gas inlet port and the duplex outlet port so that the inlet gas may flow therebetween. In addition, a maximum volume of inlet gas will flow along a flow path from the gas inlet port, into the orifice formed in the first narrow relief area and through the internal passage of the spool valve so as to be blown to the atmosphere via the vacuum generating venturi and the exhaust port. At the same time, the second narrow relief area is moved in the spool valve bore so as to connect the internal vacuum passage to the system under test at the dual vacuum inlet port. The inlet gas being blown to the atmosphere from the vacuum generating venturi creates a maximum vacuum in the internal vacuum passage for causing hydrocarbon vapors to be suctioned from the system under test and creating a vacuum condition therewithin. The hydrocarbon vapors that are pulled from the system under test are diluted by the inlet gas being supplied from the gas inlet port to reduce the chance for an explosion.

The pushing force applied to the spool valve control plunger is now released at the end of the vacuum stage to permit the spring to expand and release its stored energy, whereby the spool valve is driven rearwardly through the spool valve bore and back to the initial at-rest stage. A vacuum gauge coupled to the dual vacuum inlet port monitors the decay of the vacuum condition established in the system under test. If the vacuum condition holds relatively steady over time, an indication is provided that the system under test is leak free. However, if the vacuum condition in the system under test decays over time, another indication is provided that the system under test has a leak in need of repair.

DESCRIPTION OF THE PREFERRED EMBODIMENT

Figure 1:
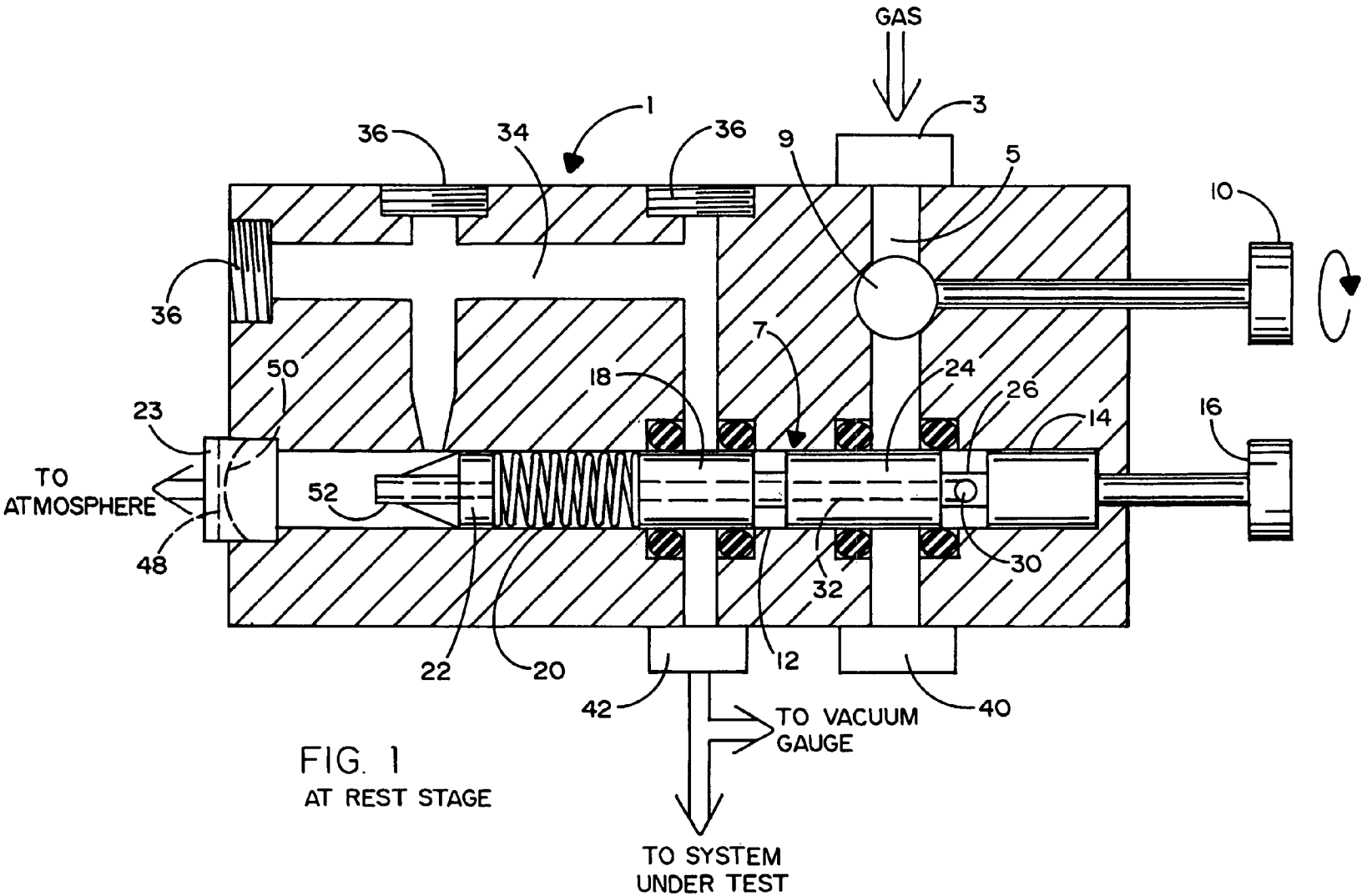
FIG. 1 is a cross-section of a vacuum generator according to a preferred embodiment of this invention in an at-rest stage for vacuum-decay leak testing the evaporative emissions system of a motor vehicle.

The compact (e.g., hand held) vacuum generator 1 which has application in testing for leaks in the evaporative emissions system of a motor vehicle is initially described while referring to FIG. 1 of the drawings. A source of gas under pressure is connected to a filtered (e.g., threaded or quick-connect) gas inlet port 3 of the vacuum generator 1. The gas applied from the source to gas inlet port 3 may be, for example, compressed shop air or a non-combustible inert gas, such as nitrogen or carbon dioxide. A non-combustible gas will be especially advantageous in situations where the vacuum generator 1 will be used in a potentially hazardous, hydrocarbon vapor filled environment.

Located within an inlet gas pressure passage 5 between gas inlet 3 and an integrated spool valve 7 is a pressure regulator 9. An external regulator adjustment knob 10 is coupled to pressure regulator 9 to be rotated so as to selectively control the rate at which the inlet gas flows from gas inlet port 3 to the spool valve 7 in order to trim the regulator pressure and thereby adjust the strength of the vacuum to be established by vacuum generator 1.

Figure 2:
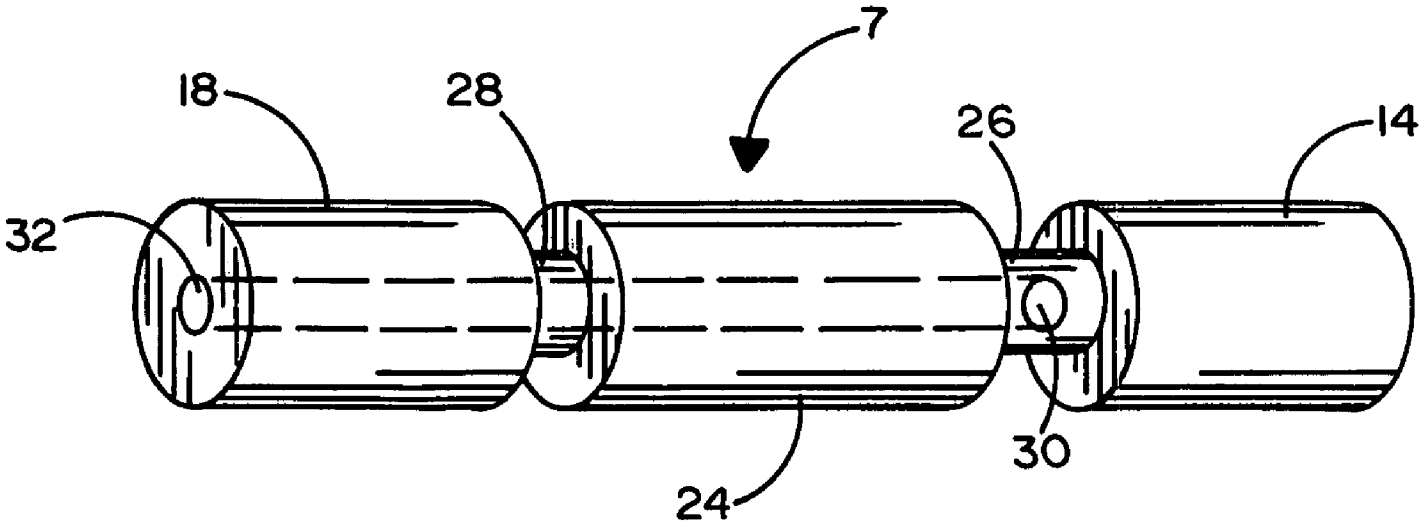
FIG. 2 is a perspective view of a spool valve which slides through a spool valve bore in the vacuum generator of FIG. 1 for enabling the vacuum-decay leak testing of the evaporative emissions system.

The spool valve 7 is disposed within and slidable through an O-ring sealed, gas tight spool valve bore 12 that is formed in the vacuum generator 1. Referring briefly to FIG. 2 of the drawings, details of the integrated spool valve 7 are now disclosed. Located at one end of spool valve 7 is a cylindrical distal spool 14. Coupled to the distal spool 14 is a spool valve control plunger (designated 16 in FIG. 1). A pushing force applied to plunger 16 is transferred to spool valve 7 at the distal spool 14 to cause the spool valve 7 to slide through the spool valve bore 12 in a manner that will soon be disclosed.

Located at the opposite end of spool valve 7 is a cylindrical proximal spool 18. The proximal spool 18 abuts a (e.g., coiled) spool return spring 20 within the spool valve bore 12. The spool return spring 20 is disposed between the proximal spool 18 of spool valve 7 and a stationary vacuum generating venturi 22. The vacuum generating venturi 22 has an interchangeable nozzle 52 that is axially aligned with an exhaust port 23 to the atmosphere. The spring 20 is normally expanded as shown in FIG. 1 to bias the spool valve 7 to an at-rest stage within the spool valve bore 12 of vacuum generator 1. However, as will be described in greater detail hereinafter, when a pushing force is applied to the spool valve control plunger 16, the spool valve 7 will slide through the spool valve bore 12 to cause the spring 20 to be compressed against the stationary venturi 22.

Located between the opposing distal and proximal spools 14 and 18 of spool valve 7 is an intermediate cylindrical spool 24. A first relatively narrow relief area 26 is established between the distal spool 14 and the intermediate spool 24, and a second relatively narrow relief area 28 is established between the proximal spool 18 and the intermediate spool 24. The first relief area 26 is preferably longer than the second relief area 28. An orifice 30 is formed in the first relief area 26. Orifice 30 communicates with an internal passage 32 that runs longitudinally between the proximal and intermediate spools 18 and 24 of spool valve 7 so as to be axially aligned and communicate with the vacuum generating venturi 22.

Returning once again to FIG. 1, the spool valve 7 is shown during the at-rest stage (i.e., when no pushing force is applied to the spool valve control plunger 16) relative to the inlet pressure passage 5 and to an internal vacuum passage 34. The internal vacuum passage 34 is formed in vacuum generator 1 so as to be capable of communicating with each of a dual vacuum inlet port 42 and the vacuum generating venturi 22. The internal vacuum passage 34 is sealed off from the atmosphere by a plurality of port plugs 36 so that a vacuum can be established and maintained therewithin.

The port plugs 36 also function as a pressure release should the vacuum generator 1 become over-pressurized.

In the at-rest stage of the vacuum generator 1 shown in FIG. 1, the spool valve 7 is positioned within the spool valve bore 12 so that the intermediate spool 24 blocks communication between the inlet pressure passage 5 and a duplex outlet port 40. The duplex outlet port 40 allows the vacuum generator 1 to be coupled to an optional external sensor or to one or more external slave units (designated 1' and best shown in FIGS. 5-7). Moreover, communication between the gas inlet port 3 and the orifice 30 leading to the internal passageway 32 of spool valve 7 is also blocked during the at-rest stage of the vacuum generator 1. At the same time, communication between the internal vacuum passage 34 and the dual vacuum inlet port 42 is likewise blocked. The dual inlet port 42 allows the vacuum generator 1 to be coupled to each of a closed system to be tested for leaks as well as to a vacuum gauge by which to monitor the decay characteristics of a vacuum condition that is established by vacuum generator 1 within the system under test. By way of example only, one particular system that may be tested for leak integrity by the vacuum generator 1 of this invention is the fuel tank of a motor vehicle. To this end, a filtered, flexible rubber hose or other suitable conduit (not shown) can be connected between the dual vacuum inlet port 42 and a fuel tank so that a vacuum can be drawn and maintained therein, as will now be described.

Figure 3:
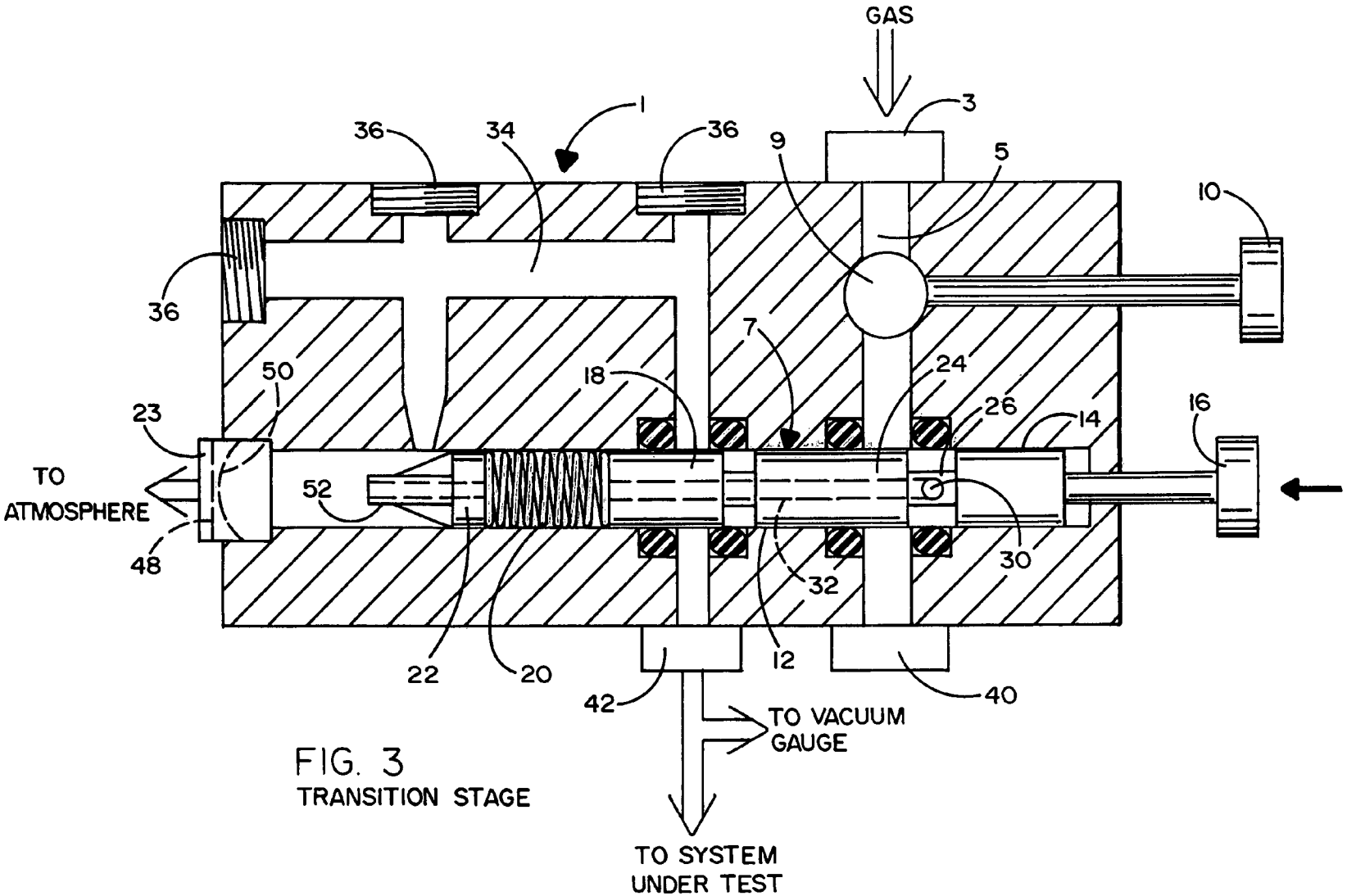
FIG. 3 shows the vacuum generator of FIG. 1 with the spool valve of FIG. 2 moved through the spool valve bore during a transition stage.

Turning now to FIG. 3 of the drawings, the vacuum generator 1 is shown in a transition stage (i.e., between the at-rest stage of FIG. 1 and a soon to be described vacuum stage of FIG. 4) with the dual vacuum inlet port 42 connected to the system (e.g., fuel tank) under test for leak integrity. In this case, a pushing force is applied to the spool valve control plunger 16 to cause the integrated spool valve 7 to begin to slide through the spool valve bore 12. The pushing force can be generated by the user's thumb against control plunger 16. In the alternative, external electromechanical, hydraulic or mechanical means may also be used to generate the pushing force against the control plunger 16. The advancement of spool valve 7 through bore 12 causes the narrow relief area 26 between the distal and intermediate spools 14 and 24 of spool valve 7 to correspondingly move into a partial axial alignment with the inlet gas pressure passage 5.

Accordingly, a partially open path is now created to enable the gas under pressure being supplied to gas inlet port 3 to flow to the internal passage 32 running through the spool valve 7 by way of the gas inlet pressure passage 5 and the orifice 30 in relief area 26. The gas under pressure will be blown through passage 32 and outwardly from a nozzle of the vacuum generating venturi 22 to the atmosphere at exhaust port 23, whereby to purge the surrounding area of any lingering, potentially explosive vapors. According to a preferred embodiment, the exhaust port 23 is provided with a sound muffler 48 and an integral flame arrester 50.

Also during the transition stage of FIG. 3, the proximal spool 18 of spool valve 7 compresses the spring 20 against the stationary venturi 22, whereby spring 20 will begin to store potential energy. As long as a pushing force is maintained on the plunger 16, the spring 20 will be unable to expand and release its stored energy for the purpose of driving spool valve 7 backwards through the spool valve bore 12 to return to the at-rest stage of FIG. 1.

As will be appreciated from FIG. 3, the proximal spool 18 of spool valve 7 is positioned within the spool valve bore 12 during the transition stage so as to maintain the previous at-rest separation of the internal vacuum passage 34 from the dual vacuum inlet port 42. Therefore, during the transition stage, the vacuum passage 34 of vacuum generator 1 will be disconnected from the system to be tested. Nevertheless, as the inlet gas from inlet port 3 and pressure passage 5 is blown to the atmosphere via the vacuum generating venturi 22 and exhaust port 23, a vacuum will be initiated within the internal vacuum passage 34 of vacuum generator 1 which communicates with venturi 22.

Figure 4:
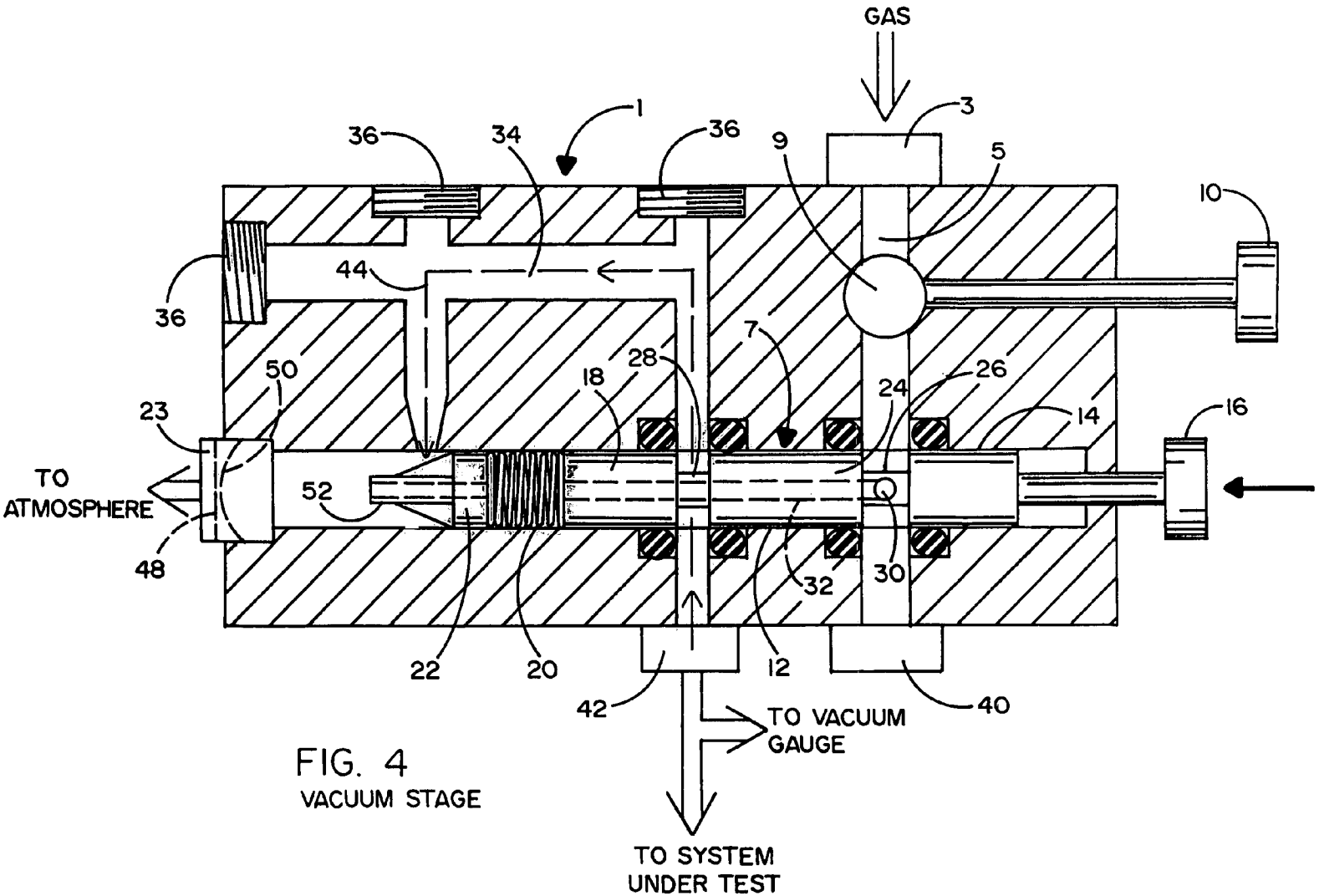
FIG. 4 shows the vacuum generator of FIG. 1 with the spool valve moved through the spool valve bore during a vacuum stage.

FIG. 4 of the drawings shows the vacuum generator 1 in the vacuum stage. In this case, the pushing force applied to the spool valve control plunger 16 advances the spool valve 7 through the spool valve bore 12 so that the internal vacuum passage 34 will now be connected at the dual vacuum inlet port 42 to the system to be tested for leaks. That is, the displacement of spool valve 7 through bore 12 causes the narrow relief area 28 between the proximal and intermediate spools 18 and 24 of spool valve 7 to correspondingly move into axial alignment with the internal vacuum passage 34. At the same time, the narrow relief area 26 between the distal and intermediate spools 14 and 24 of spool valve 7 is moved into full, wide open axial alignment with inlet gas passage 5.

In this regard, an unobstructed gas flow path is created to enable the maximum volume of gas under pressure to flow from gas inlet port 3 and gas inlet pressure passage 5 through the internal passage 32 of spool valve 7 via the orifice 30 to the vacuum generating venturi 22. The volume of gas exiting the nozzle 52 of venturi 22 now causes a maximum vacuum to be generated within the internal vacuum passage 34. Therefore, a suction effect is produced within vacuum passage 34 by which to draw hydrocarbon vapors out of the system to be tested as the system is evacuated. More particularly, gasoline vapors, and the like, are suctioned through a vacuum path 44 including the dual vacuum inlet port 42, the narrow relief area 28 of spool valve 7, and the internal vacuum passage 34 to be blown to the atmosphere by venturi 22 through the exhaust port 23. The nozzle 52 of venturi 22 can be interchanged with a different sized nozzle to control the suction effect within passage 34 and the rate at which the vapors are blown to the atmosphere. In this regard, the size of the nozzle 52 is selected such that the rate at which the vapors are blown to the atmosphere is greater than the flame speed of the vapors.

In particular, the inlet gas under pressure which is blown to the atmosphere through the exhaust port 23 from the nozzle of vacuum generating venturi 22 carries with it the vapors which have just been suctioned from the system under test. By virtue of the foregoing, the potentially explosive vapors will be diluted by the inlet gas so as to reduce a chance for an explosion. In addition, the temperature of the blown vapors will be reduced because of the pressure drop caused by the venturi 22.

In the vacuum stage of FIG. 4, with the integrated spool valve 7 pushed through the spool valve bore 12, the spool return spring 20 will be fully compressed against the stationary vacuum generating venturi 22 to store its maximum potential energy. At the conclusion of the vacuum stage, the pushing force that has heretofor been applied to the spool valve control plunger 16 is released. The spring 20 will now expand and release its stored energy, whereby to drive the spool valve 7 in an opposite direction through bore 12 and back to the at-rest stage shown in FIG. 1. Thus, the vacuum generator 1 is once again isolated and blocked from the system to be tested by the proximal and intermediate spools 18 and 24 of spool valve 7. As the spool valve 7 once again travels through the transition stage (of FIG. 3), the area surrounding the exhaust port 23 will once again be purged of lingering vapors by means of the gas under pressure being blown through passage 32 from inlet 3 and pressure passage 5.

Now that a full or near vacuum condition has been created in the system to be tested for leak integrity, the vacuum gauge that is coupled to the dual vacuum inlet port 23 is monitored for a sign of leak decay. In the event that the vacuum condition of the system under test holds relatively steady over time, then an indication is provided that the system is leak free. On the other hand, if the vacuum condition of the system under test decays over time, then a different indication is provided that the system contains an undesirable leak which should be repaired to reestablish leak integrity. At the conclusion of the leak test, the adjustment knob 10 to pressure regulator 9 can now be rotated at the same time that the spool valve control plunger 16 is depressed when it is desirable to supply sufficient gas under pressure from inlet port 3 to the system under test to safely increase the pressure towards its normal ambient pressure and thereby enable the system under test to begin to fill with (e.g., non-combustible) gas.

The vacuum generator 1 can be disconnected at the dual vacuum inlet port 42 thereof from the system under test to await a new leak integrity test for another system in the manner which has just been described.

Figure 5:
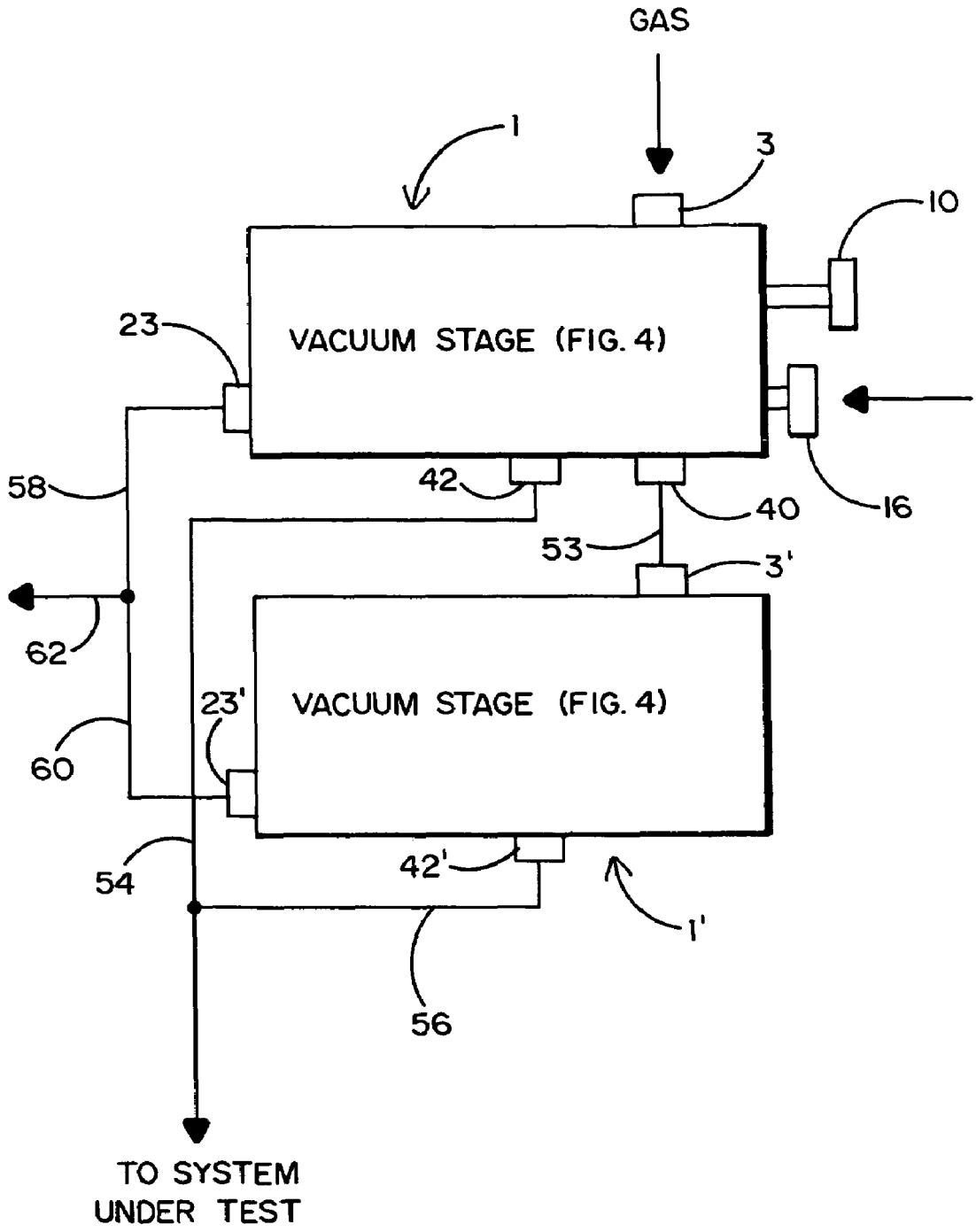
FIGS. 5-7 show the vacuum generator with the spool valve thereof during the vacuum stage coupled to a slave vacuum generating unit.
Figure 6:
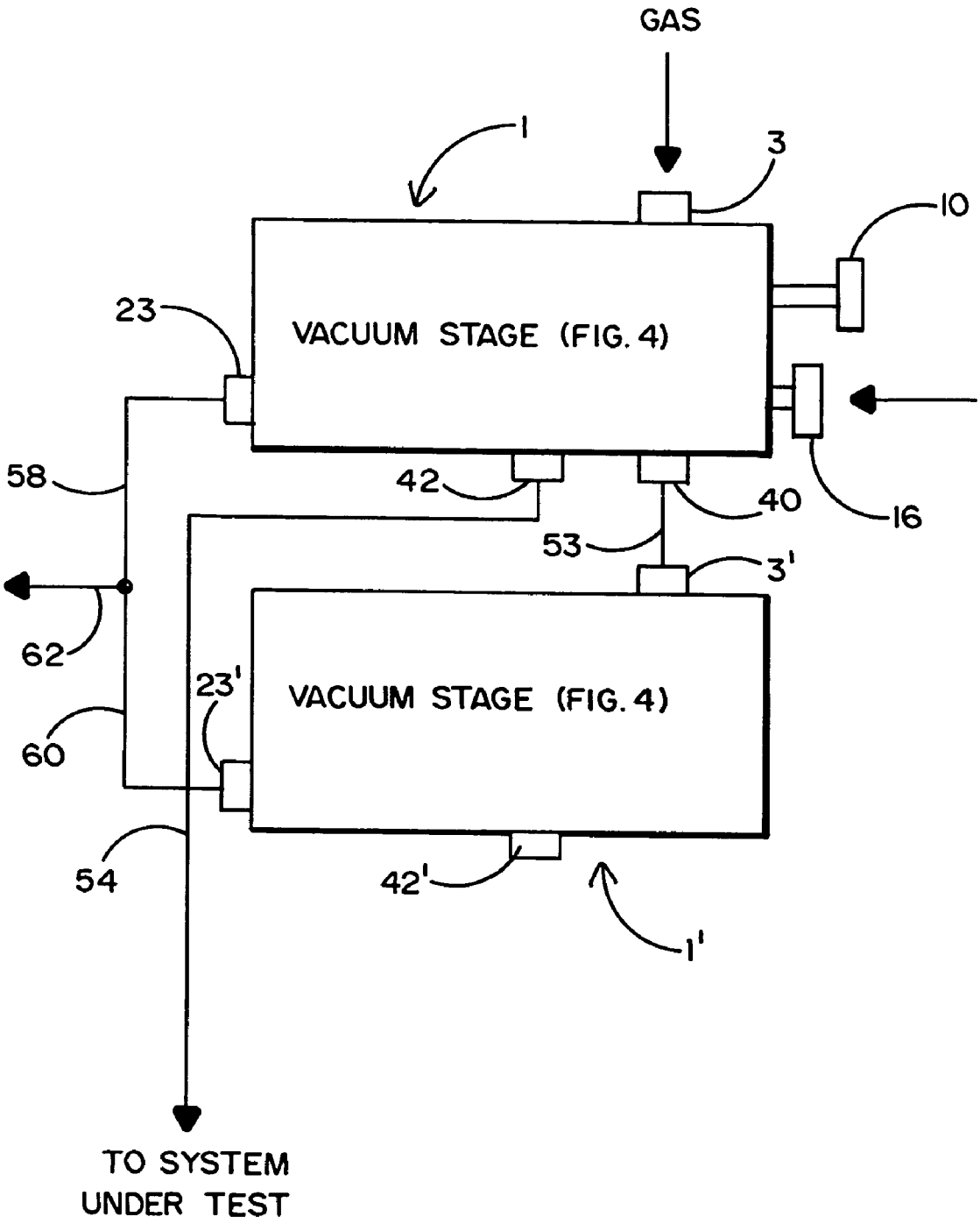
Figure 7:
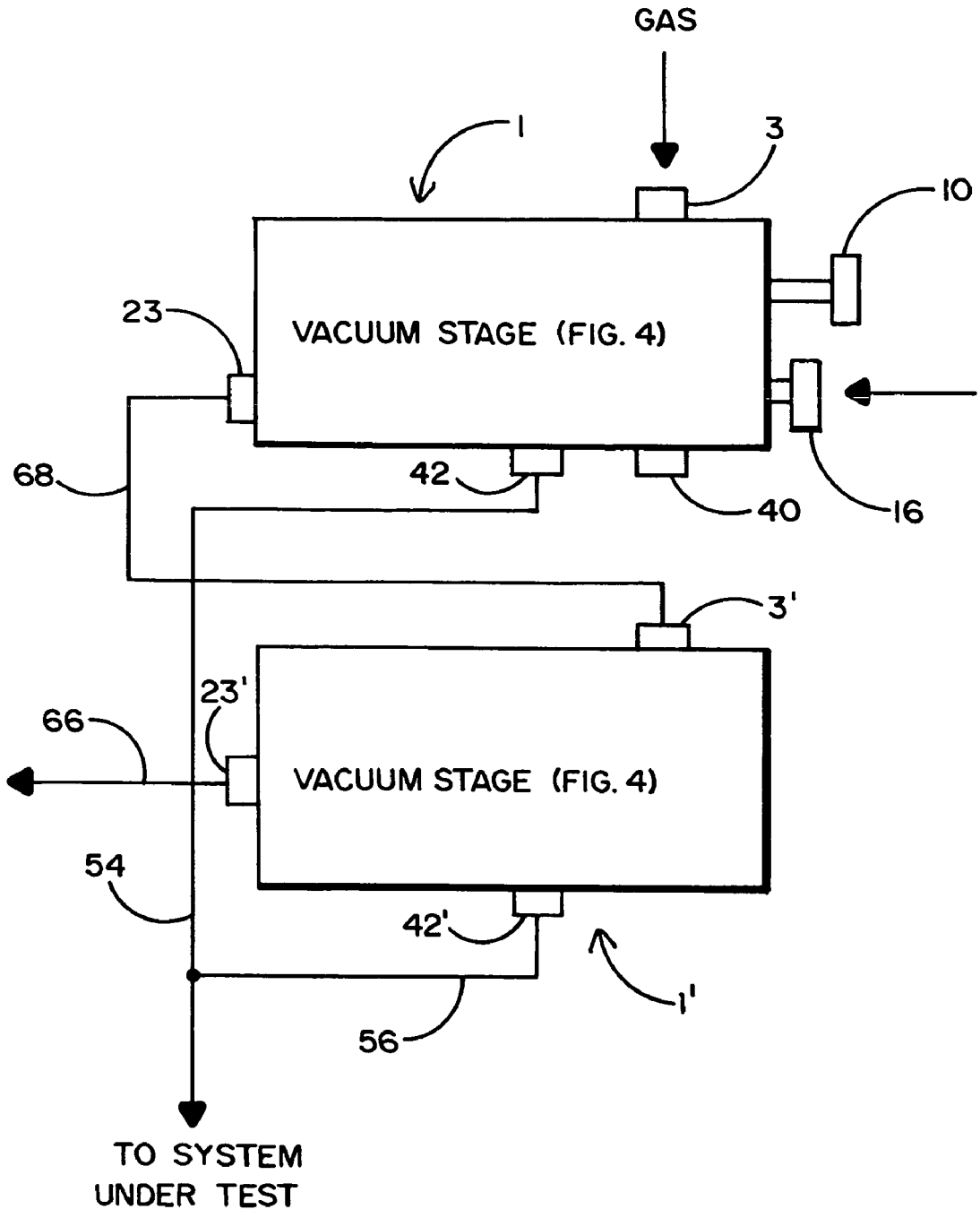

FIGS. 5-7 of the drawings show the vacuum generator 1 of this invention operating in tandem with a slave vacuum generator 1'. Although only a single slave vacuum generator 1' is shown in FIGS. 5-7, it is to be understood that any number of slave units may be coupled in series or parallel to the vacuum generator 1. In this regard, a single vacuum generator 1 operating as a master unit can regulate and control one or more slave units 1'. In each case, a maximum pushing force is applied to the spool valve control plunger 16 of the master vacuum generator 1 to cause the integrated spool valve thereof (designated 7 in FIGS. 1-4) to slide through the spool valve bore to the position shown in FIG. 4 during the vacuum stage. Therefore, gas under pressure will be blown outwardly from the exhaust port 23 to create a suction effect at the dual vacuum inlet port 42 of vacuum generator 1 for evacuating the system under test.

The slave vacuum generator 1' to be coupled to the master vacuum generator 1 in each of FIGS. 5-7 includes a gas inlet port 3', and exhaust port 23', and a dual vacuum inlet port 42'. However, the slave unit 1' is modified so that the pressure regulator (designated 9 in FIG. 4), the regulator adjustment knob (designated 10), the spool valve control plunger (designated 16), and the duplex outlet port (designated 40) are omitted. Nevertheless, a duplex outlet port 40 may be required if the slave unit 1' is to be coupled to an additional slave unit (not shown).

Each slave vacuum generator 1' has an integrated spool valve which is initially moved to and fixed in the same position as the spool valve 7 of the master vacuum generator 1 during the vacuum stage of FIG. 4. Thus, gas under pressure being supplied to the gas inlet port 3' of the slave vacuum generator 1' will be blown outwardly from the exhaust port 23' to the atmosphere to create a suction effect at the dual vacuum inlet port 42'.

In FIG. 5, the duplex outlet port 40 of the master vacuum generator 1 is coupled to the gas inlet port 3' of the slave vacuum generator 1' by a gas line 53. Respective suction lines 54 and 56 from the duplex outlet ports 42 and 42' of the master and slave units 1 and 1' are interconnected so as to communicate with the system under test for leaks. Respective gas lines 58 and 60 from the exhaust ports 23 and 23' of the master and slave units 1 and 1' are also interconnected so as to communicate with the atmosphere.

It may be appreciated that gas supplied to the gas inlet port 3 of the master vacuum generator 1 will be blown to the atmosphere at an exhaust port 62 that is common to both the master and slave units 1 and 1'. At the same time, the vacuum generating venturi (designated 22 in FIG. 4) of both the master and slave units 1 and 1' will be operating in tandem to draw a vacuum in the system under test via suction lines 54 and 56. Therefore, by virtue of the master and slave vacuum generators 1 and 1' being coupled in parallel with one another as shown in FIG. 5, the speed at which a vacuum is created in the system to be leak tested is increased (e.g., doubled).

FIG. 6 shows a variation of the parallel coupling of the master and slave vacuum generators 1 and 1' illustrated in FIG. 5. In this case, the suction line (designated 56 in FIG. 5) from the dual vacuum inlet port 42' of slave unit 1' that was previously interconnected with suction line 54 of master unit 1 is now eliminated. Thus, only a single suction line 54 runs from the dual vacuum inlet port 42 of the master unit 1 to the system under test. By virtue of the coupling between the master and slave vacuum generators 1 and 1' as shown in FIG. 6, the respective vacuum generating venturi thereof will cooperate with one another so that a larger volume of gas will be blown to the atmosphere at the common exhaust port 62. Accordingly, there will be increase in the dilution effect that is produced as the gas under pressure that is supplied to the gas inlet port 3 of the master unit 1 is mixed with the vapors that are suctioned from the system under test as a vacuum is created therewithin.

FIG. 7 shows another variation of the coupling of the master and slave vacuum generators 1 and 1' of FIG. 5. In this case, the gas lines (designated 53 and 58 in FIG. 5) are replaced by a gas line 66 that runs from the exhaust port 23 of the master unit 1 to the gas inlet port 3' of the slave unit 1'. Therefore, the common exhaust 62 of FIG. 5 is eliminated, and a single exhaust line 66 now extends from the exhaust port 23' of slave unit 1' to the atmosphere. In addition, the gas that is blown from the exhaust port 23 of master unit 1 is now supplied to the gas inlet port 3' of the slave unit 1' by way of a gas line 68. Accordingly, by virtue of coupling the master and slave vacuum generators 1 and 1' in series as shown in FIG. 7, a stronger suction effect is generated by the respective vacuum generating venturi thereof so as to increase the efficiency by which a vacuum is created in the system to be leak tested via the interconnected suction lines 54 and 56 and the single exhaust line 66.

As indicated, the vacuum generator 1 herein disclosed has particular application for use with the evaporative emissions system of a motor vehicle to be tested for leaks. However, it should be recognized that the vacuum generator of this invention may also be coupled to other closed systems (e.g., tanks, air conditioning units, and the like) that are suitable to be vacuum-decay leak tested in the manner that has been described above.

I claim:

1. A vacuum generator for pulling a vacuum in a system to be tested for leaks, said vacuum generator comprising:

a source of inlet gas under pressure;

a spool valve having an internal passage running therethrough, said spool valve moving through a spool valve bore in response to a pushing force applied to said spool valve;

a vacuum generating venturi located between the internal passage of said spool valve and the atmosphere; and a vacuum passage to be connected between the system under test and said vacuum generating venturi so that the system under test can be evacuated to the atmosphere, said spool valve moving from a first position within said spool valve bore at which the internal passage running through said spool valve is isolated from said source of inlet gas and said vacuum passage is disconnected from the system under test to a second position within said spool valve bore at which the internal passage running through said spool valve communicates with said source of inlet gas to complete a gas flow path along which gas under pressure is blown from said source of inlet gas to the atmosphere by way of said vacuum generating venturi, and said vacuum passage is connected to the system under test to complete a vacuum path from the system under test to the atmosphere, whereby a vacuum condition is created in the system under test by means of said vacuum generating venturi, the ability of the system under test to maintain the vacuum condition over time providing an indication if the system under test has a leak.

2. The vacuum generator recited in claim 1, further comprising a control plunger connected to said spool valve, said control plunger receiving the pushing force for moving said spool valve from said first position to said second position within said spool valve bore.

3. The vacuum generator recited in claim 1, further comprising a gas pressure regulator located between the source of inlet gas and the internal passage running through said spool valve, said gas pressure regulator controlling the rate at which inlet gas under pressure is supplied from said source thereof to said internal passage to correspondingly control the vacuum condition that is created in the system under test when said spool valve is moved to the second position within said spool valve bore.

4. The vacuum generator recited in claim 1, wherein said source of gas is compressed air.

5. The vacuum generator recited in claim 1, wherein said source of gas is an inert, non-combustible gas.

6. The vacuum generator recited in claim 1, further comprising an outlet port at which said vacuum generator is coupled to a slave vacuum generator when the spool valve of said vacuum generator is moved to the second position within said spool valve bore so that gas under pressure from said source of inlet gas is supplied to said slave vacuum generator from said outlet port.

7. The vacuum generator recited in claim 1, further comprising an exhaust port located between said vacuum generating venturi and the atmosphere, said exhaust port including a flame arrester.

8. The vacuum generator recited in claim 7, wherein said exhaust port also includes a silencer.

9. The vacuum generator recited in claim 1, wherein said vacuum generating venturi is fixedly connected within said spool valve bore in axial alignment with the internal passage running through said spool valve.

10. The vacuum generator recited in claim 9, further comprising a spring located in said spool valve bore between said spool valve and said vacuum generating venturi, said spring being compressed between said spool valve and said vacuum generating venturi when the pushing force is applied to said spool valve to cause said spool valve to move through said bore from said first position to said second position, and said spring expanding and releasing its stored energy when said pushing force is removed from said spool valve to drive said spool valve through said bore from said second position back to said first position.

11. The vacuum generator recited in claim 1, further comprising a dual vacuum inlet port at which said vacuum passage is connected to the system under test when said spool valve is moved to the second position within said spool valve bore.

12. The vacuum generator recited in claim 11, wherein said dual vacuum inlet port is adapted to be coupled to a vacuum gauge that is responsive to the vacuum condition in the system under test when said spool valve is moved to the second position within said spool valve bore to connect said vacuum passage to the system under test.

13. The vacuum generator recited in claim 1, wherein the system to be tested to which said vacuum passage is connected when said spool valve is moved to the second position within said spool valve bore is the evaporative emissions system of a motor vehicle.

14. The vacuum generator recited in claim 13, wherein the evaporative emissions system of the motor vehicle to be tested is a fuel tank.

15. The vacuum generator recited in claim 1, wherein said spool valve includes at least first and second spools, said first spool being disposed within said spool valve bore during the first position of said spool valve to block the connection of said vacuum passage to the system under test, and said second spool being disposed within said spool valve bore during the first position of said spool valve to block the communication of the internal passage running through said spool valve with said source of inlet gas.

16. The vacuum generator recited in claim 15, wherein the first spool of said spool valve is relocated within said spool valve bore during the second position of said spool valve to enable the connection of said vacuum passage to the system under test, and the second spool of said spool valve is relocated within said spool valve bore during the second position of said spool valve to enable the communication of the internal passage running through said spool valve with said source of inlet gas.

17. The vacuum generator recited in claim 16, wherein said spool valve includes an orifice communicating with the internal passage running through said spool valve, said orifice being positioned between said internal passage and said source of inlet gas to establish said gas flow path between said source of inlet gas and the atmosphere by way of said internal passage and said vacuum generating venturi when said spool valve is moved to the second position within said spool valve bore.

18. A vacuum generator for pulling a vacuum in a system to be tested for leaks, said vacuum generator comprising:

a source of gas under pressure;

a vacuum generating venturi having an outlet nozzle communicating with the atmosphere;

a gas flow path located between said source of gas under pressure and said vacuum generating venturi so that gas under pressure from said source is supplied to said venturi to be blown to the atmosphere from the nozzle thereof; and a suction passage to lie in communication between the system under test and the outlet nozzle of said vacuum generating venturi along which the system under test is evacuated to the atmosphere and a vacuum condition is created in response to said gas under pressure being blown to the atmosphere from said venturi nozzle, the ability of the system under test to maintain the vacuum condition over time providing an indication if the system under test has a leak.

19. The vacuum generator recited in claim 18, further comprising a spool valve moving through a spool valve bore, said gas flow path running through said spool valve so that gas under pressure is supplied from said source thereof to said vacuum generating venturi for creating the vacuum condition in the system under test.

20. The vacuum generator recited in claim 19, wherein said spool valve moves from a first position in said spool valve bore at which said suction passage is isolated from the system under test to a second position in said spool valve bore at which said vacuum passage communicates with the system under test so that the vacuum condition can be created therewithin.

* * * * *